United States Patent [19]

Smith

[11] 4,372,493

[45] Feb. 8, 1983

[54] ROOF COOLING SYSTEM

[76] Inventor: Jimmie L. Smith, 1812 Boulder, Plano, Tex. 75023

[21] Appl. No.: 219,932

[22] Filed: Dec. 24, 1980

Related U.S. Application Data

[63] Continuation-in-part of Ser. No. 124,813, Feb. 26, 1980, abandoned.

[51] Int. Cl.[3] ..... B05B 15/00

[52] U.S. Cl. ..... 239/208; 239/229

[58] Field of Search ..... 52/168; 137/357; 239/200, 208, 209, 229, 575, DIG. 22; 62/259.4; 285/156

[56] References Cited

U.S. PATENT DOCUMENTS

| | | | |
|---|---|---|---|
| 964,464 | 7/1910 | Crawford-Frost . | |
| 1,648,026 | 11/1927 | Murray | 285/156 X |
| 1,831,880 | 11/1931 | Pierce . | |
| 2,396,449 | 3/1946 | Wahlin | 239/575 X |
| 2,506,936 | 5/1950 | Murray . | |
| 2,758,874 | 8/1956 | Snyder . | |
| 2,865,674 | 12/1958 | Jelmeland . | |
| 2,977,963 | 4/1961 | Klint . | |
| 3,030,031 | 4/1962 | Barker . | |
| 3,587,972 | 6/1971 | Weeth . | |
| 3,633,826 | 1/1972 | Baker . | |

FOREIGN PATENT DOCUMENTS

| | | | |
|---|---|---|---|
| 1806634 | 5/1970 | Fed. Rep. of Germany | 239/229 |
| 689547 | 4/1953 | United Kingdom . | |

*Primary Examiner*—Andres Kashnikow

*Attorney, Agent, or Firm*—Hubbard, Thurman, Turner & Tucker

[57] ABSTRACT

Water distributing apparatus for uniformly wetting a roof to provide evaporative cooling. The apparatus includes a generally horizontal water conduit supported on a roof, a flexible tube attached to an upper surface of the conduit and a directional nozzle attached to a second end of the flexible tube. The directional nozzle has an outlet angularly displaced from the longitudinal axis of the second end of the flexible tube to provide rapid generally random movement of the nozzle about its point of attachment to the water supply conduit. In one preferred embodiment the conduit includes spaced apart conduit tee components having upstanding branches into which are fitted plugs supporting connector fittings for the flexible tubes. A filter screen is mounted in each of the plugs. An upstanding sleeve surrounds the tube connector fitting and is operable to engage the flexible tube to minimize snagging of the directional nozzle under the edges of the roof shingles and control the flailing action of the tubes.

16 Claims, 6 Drawing Figures

ROOF COOLING SYSTEM

CROSS REFERENCE TO RELATED APPLICATION

This application is a continuation-in-part of my prior co-pending application Ser. No. 124,813 filed: Feb. 26, 1980, now abandoned.

BACKGROUND OF THE INVENTION

The present invention relates to water distributing apparatus and more particularly to a water sprinkler system for use in uniformly wetting a roof structure.

References known to the present applicant and believed to be relevant to the present invention include the following U.S. Pat. Nos. 1,831,880 issued to Pierce; 2,865,674 issued to Jelmeland; 3,587,972 issued to Weeth; and 3,633,826 issued to Baker. The Pierce patent teaches a fire protection and roof cooling arrangement comprising basically a length of perforated pipe positioned on the ridge of a roof. The Jelmeland patent also teaches a roof cooling and fire prevention system in which somewhat conventional spray nozzles are positioned along the eaves of a roof to provide a water spray reaching all the way to the roof ridge. This patent also recognizes that in general excess amounts of water must be sprayed onto a roof to fully wet it with the result that much water runs off. The Jelmeland patent includes a recirculating pump system to avoid wasting the runoff water.

The patents to Weeth and Baker each provide apparatus for distribution of water in irrigation or lawn sprinkling systems. In each of these patents, a generally vertically extending flexible tube or hose is used as a discharge nozzle from a main water conduit to distribute irrigation water over as large a ground surface as possible. The normal reaction force produced by water flowing from the nozzle causes the flexible tube or hose in each of these patents to rotate in a generally circular pattern with the end of the hose directed at a fairly high angle, on the order of 45°, to provide maximum distribution of the water. In the Baker patent, it is also taught that splitting of the end of the rubber tube will break up the flow of water from the nozzle into a spray of small water droplets more desirable in the lawn sprinkling situation.

As taught by the first two above referenced patents, the sprinkling of water on a building roof will aid in cooling the entire structure. As can also be seen from those patents, the previously known systems tend to distribute much more water onto the roof structure than is actually needed for proper wetting. The perforated pipe arrangement taught by Pierce tends to produce a large number of distinct rivulets of water extending from each pipe perforation to the roof edge with dry roof areas in between. The sprinkler arrangement of Jelmeland breaks the water up into small droplets which are randomly distributed and therefore can provide essentially complete wetting of the roof. However, such a sprinkler arrangement is inefficient, especially if windy conditions are considered. The water droplets which must travel a great distance through the air before striking the roof may partly evaporate while in the air and tend to be carried completely away from the roof depending on the ambient wind velocity. As illustrated by the drawings in that patent, a considerable amount of the spray will extend beyond the roof edges to insure that the entire roof structure is wet. Excess water is also applied to be sure of complete wetting and then the excess is collected and recirculated.

Another problem found in these prior systems is that relatively high water supply pressure must be provided to the sprinkler head. For example, in the Jelmeland device, pressure must be sufficient to break the water into a fine mist and propel the mist to the roof ridge. In the Weeth and Baker devices the flexible tube is relatively stiff, and relatively high water pressure is required to cause the desired rotation.

It can be seen, therefore, that it is desirable to provide a system for wetting a roof structure to aid in cooling the structure, thereby reducing the cost of air conditioning the structure in warm climates. It can also be seen that it is desirable to provide uniform wetting of a roof structure and to do so using the least amount of water and at relatively low pressure. While it is desirable to uniformly distribute water on the roof structure, it can be seen that it is not desirable to break the water up into small droplets and spray them over long distances to the roof surface since windy conditions can cause considerable loss of water when such arrangment is employed.

SUMMARY OF THE INVENTION

Accordingly, an object of the present invention is to provide an improved water distributing system for wetting a structure roof.

Another object of the present invention is to provide a roof sprinkling system which provides uniform roof wetting with minimum water usage.

Another object of the present invention is to provide a roof sprinkling system which provides uniform roof wetting at a relatively low supply pressure.

Another object of the present invention is to provide a roof sprinkling system which provides minimum exposure of the distributed water to wind as it is applied to the roof surface.

Yet another object of the present invention is the provision of a roof sprinkling system which is reliable in operation, requires minimum maintenance and is easily assembled.

A roof sprinkling system according to the present invention comprises a water supply conduit adapted for attachment along the ridge of a roof, a flexible tube having a first end attached to the top of the water supply conduit, and a directional nozzle attached to a second end of the flexible tube with said nozzle having an outlet angularly displaced from the longitudinal axis of the second end of the flexible tube. In one preferred form, the flexible tube first end is attached to the supply conduit by a fitting including a pressure reducing orifice.

In another preferred form of the present invention, the supply conduit includes spaced apart conduit tee fittings having an upstanding branch conduit portion including a plug in which the tube fitting is disposed. A tubular sleeve projects upward beyond the point of attachment of the flexible tube at its first end for engagement of the tube to control the flailing action thereof. A filter screen may be provided in the plug to prevent clogging of the pressure reducing orifice and directional nozzle.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
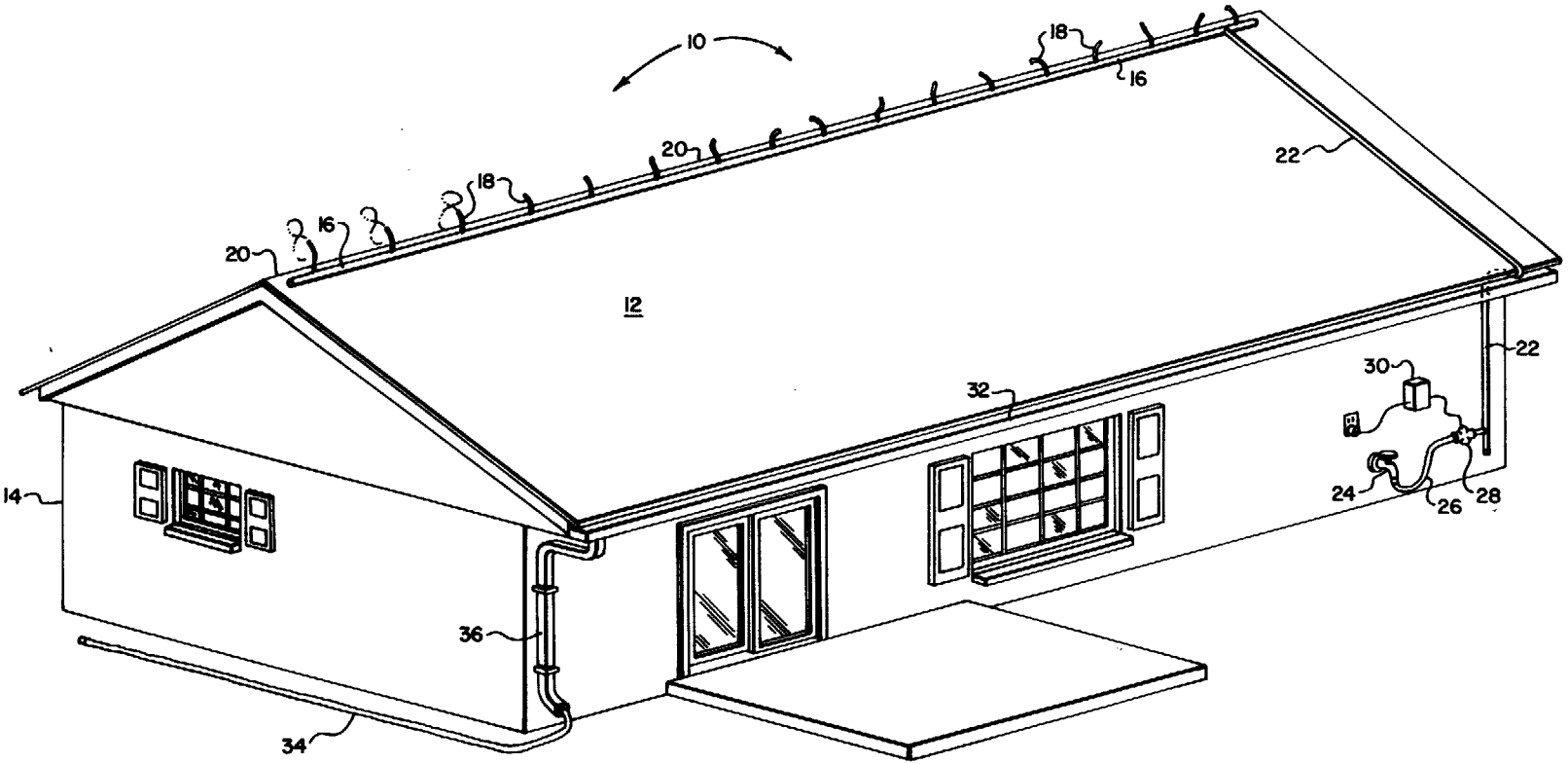
FIG. 1 is an illustration of a roof sprinkling system according to the present invention installed on a building structure.
Figure 2:
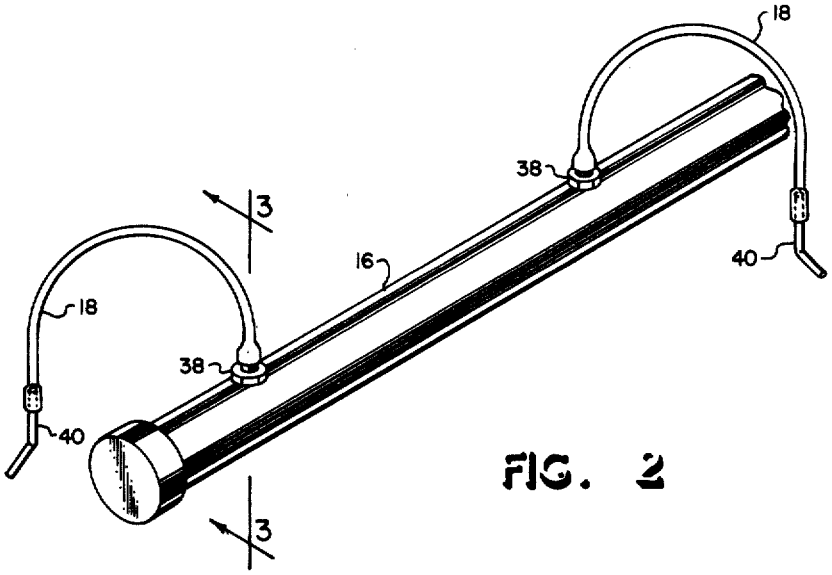
FIG. 2 is a perspective illustration of a portion of the water sprinkling system of FIG. 1.
Figure 3:
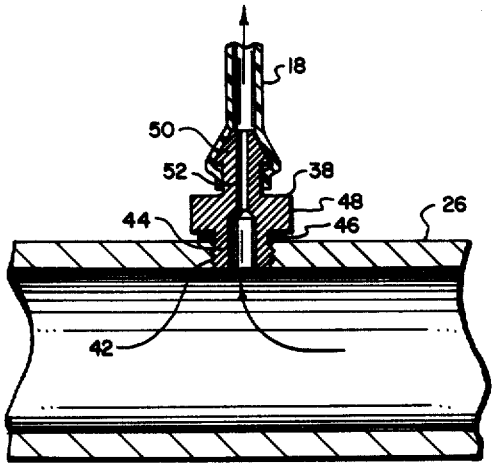
FIG. 3 is a cross-sectional illustration of a portion of the FIG. 2 apparatus.
Figure 4:
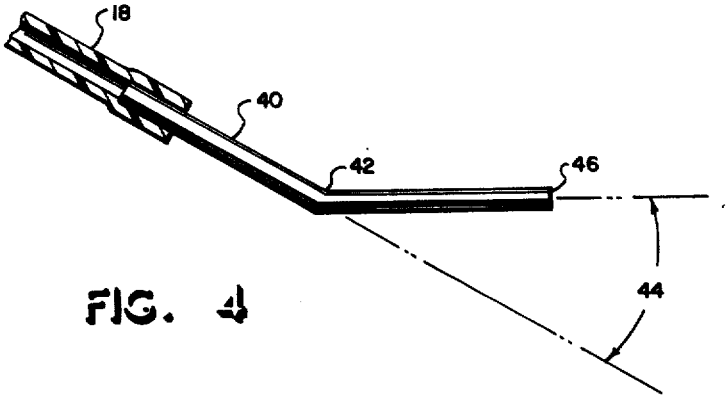
FIG. 4 is a detailed illustration of the nozzle portion of the sprinkling apparatus of FIGS. 1 and 2.

With reference now to FIG. 1, there is provided a simplified illustration of a water distributing system, generally designated 10, according to the present invention installed on a roof 12 of a building structure 14. The water sprinkling apparatus 10 comprises primarily a length of water supply conduit 16 attached to the roof 12 and a large number of flexible discharge tubes 18 attached to the upper surface of conduit 16. The water supply conduit 16 is, in the preferred embodiment, a length of nominal three-quarter inch PVC plastic pipe. The pipe 16 is preferably bolted or otherwise attached using suitable brackets to the roof 12 at or near the ridge 20. As illustrated in FIG. 1, the conduit 16 may be positioned slightly below ridge 20 so that the water sprinkler system 10 cannot be seen from the front of the building 14. The details of the flexible discharge tubes 18 and their attachment to conduit 16 are shown in FIGS. 2, 3 and 4. The discharge tubes 18 in this preferred embodiment are provided every 2.5 feet along the length of the supply conduit 16.

Water may be supplied to the conduit 16 in a number of ways. In this preferred embodiment, additional piping 22 is provided from the conduit 16 to a point on an outer wall of the structure 14. The permanent conduit 22 may be connected to a conventional water tap 24 by means of a flexible hose 26 to allow draining of the system during freezing weather as well as for other possible reasons. In this preferred embodiment, the flow of water into the sprinkler system is controlled by an electrically operated valve 28 which is in turn controlled by a clock mechanism 30. The electrical timing system 30 and valve 28 may be the same as those commonly employed on automatic yard sprinkler systems. Such systems can automatically open the valve 28 for preselected time periods and at desired intervals throughout the day. The precise setting of the control 30 depends on the particular dimensions of the roof to be cooled, the dimensions of the sprinkler system itself and the available water pressure. In general, the sprinkler time period should not be so long as to allow excess water to run off the eaves of the roof 12.

If desired, the roof 12 may be provided with guttering 32 along its eaves to catch the excess runoff water. As shown in FIG. 1, a lawn sprinkler hose 34 may be attached to downspout 36 so that any runoff water may be distributed to desired points on the surrounding lawn to provide maximum utilization of the water.

With reference now to FIG. 2, more details of the water conduit 16 and discharge tubes 18 are provided. As noted above, the conduit 16 is preferably PVC plastic pipe which is basically rigid. The water discharge tubes 18, on the other hand, are very flexible plastic material, having an outer diameter of one-eighth inch and an inner diameter of one-sixteenth inch. The flexible tubes 18 are preferably attached to the rigid conduit 16 by brass fittings 38 which are threaded into holes which have been drilled and tapped into the upper surface of conduit 16. Fittings 38 have a barbed upper end onto which the flexible tubes 18 are frictionally pressed to provide essentially permanent engagement. The details of the fittings 38 are provided in FIG. 3 and described in more detail below. The flexible tubes 18 are generally between six and seven inches long and carry directional nozzles 40 in their free ends. Each of the nozzles 40 comprises a substantially rigid tube bent at about its midpoint and having one end frictionally pressed into the flexible tubes 18. More details of the nozzles 40 are illustrated in FIG. 4 and described below.

With reference now to FIG. 3, details of the attachments of the first ends of tubes 18 to the conduit 16 are provided in a cross-sectional illustration. As noted above, a threaded hole 42 is provided in the upper surface of conduit 16 at the location of each flexible discharge tube 18. The fitting 38 includes a threaded lower end 44 which engages the threaded hole 42. A rubber washer 46 provides a water tight connection between the fitting 38 and the conduit 26. A large diameter portion 48 of the fitting 38 is hexagonally shaped so that a wrench may be used for tightening fitting 38 into conduit 16. An upper section 50 of fitting 38 is barbed to provide a water tight connection of the tube 18 to fitting 38 and to resist removal of the tubing 18. Fitting 38 has an axial passageway 52 providing communication between conduit 16 and flexible tube 18. In a preferred form, the upper portion of passageway 52 has an inner diameter of 3/64 inch over a length of about 3/16 inch and acts as a pressure-reducing orifice as explained in more detail below.

With reference now to FIG. 4, details of the water discharge nozzle 40 are illustrated. In the preferred embodiment, nozzle 40 is formed from a one-inch length of brass tubing having an inner diameter of 1/16 inch and an outer diameter of slightly greater than ⅛ inch. The nozzle 40 is bent at its midpoint 42 to an angle indicated by the arrow 44 of approximately 30°. As shown in FIG. 4, this angle is measured relative to the longitudinal axis of that portion of nozzle 40 which is inserted in the second end of flexible tube 18. As a result, the angle 44 also represents the angular displacement of the nozzle 40 outlet 46 from the longitudinal axis of the second end of the flexible tube 18 itself.

With reference now to all of the figures, the operation of the present invention will be described. With no water pressure supplied to the system, the flexible tubes 18 tend to be bent over so that nozzles 40 are aiming in a direction well below horizontal and are generally at the same elevation as the fitting 38. When water pressure is applied to the system, for example by the actuation of valve 28, the flexible tubes 18 experience several different forces. Internal pressure within the tubes 18 tends to cause these tubes to stand more erect. The small diameter orifices provided in passageways 52 in fittings 38 help reduce the average pressure within the flexible tubes 18 to thereby aid in preventing the tubes 18 from standing at too high an angle. These fluid-reducing orifices also aid in equalizing distribution of fluid flow through the large number of flexible tubes 18 on the roof ridge. The reaction force of water exiting nozzles 40 also tends to push the free ends of tubes 18 upwards. The brass discharge nozzles 40 themselves add weight to the free ends to help overcome this lifting reaction force. It can be seen that if the tubes were allowed to stand erect as in the prior art flexible tube sprinkler systems, a high angle water spray would result which would be subject to being carried off the roof 12 by wind. In the present invention, the very high ratio of length to diameter of tube 18 combined with the weight of nozzles 40 helps to insure that the water discharged from nozzles 40 travels in a generally horizontal direction as it leaves the nozzles.

It can be seen that the water leaving nozzles 40 forms a stream of large droplets which is less subject to wind dispersion than a fine mist would be. It is desirable that the stream be rapidly and randomly directed over as large a portion of the roof as possible. The bend or offset in the discharge nozzles 40 guarantees the random motion of the flexible tubes 18. Thus, the reaction force of water leaving the outlet 46 of the discharge nozzle 40 includes a component which is perpendicular to the longitudinal axis of the free end of flexible tube 18. As a result, the free end of tube 18 is always displaced sideways relative to whatever position it happens to be in. In the prior art flexible tube sprinklers, it is noted that the free end of flexible tube tends to travel in a precise circle to provide even distribution of the water. It can be seen that if the free ends of flexible tubes 18 traveled in an exact circle, the nozzles 40 would experience a rotation about the longitudinal axis of the tube 18 free ends. As a result, the direction of the sideways force on the free ends of tubes 18 would vary as the tube rotated in the circular path. That is, at some points in the rotation, the sideways force would be upwards while in others it would be downwards. As a result of this offset in the outlet of nozzles 40, the free ends of tubes 18 do not travel in an exact circular arc, but instead travel in a very rapid and random fashion, distributing water over a fairly large area considering the small size of the tubes 18. While providing this large distribution, the fluid distributing system does not spray the water upwardly to any great extent, thus minimizing the loss of water due to wind.

In testing the present invention under high wind conditions, a second beneficial effect of the very great length to diameter ratio of tubes 18 was discovered. At high wind conditions, the force applied to the tubes 18 by the wind tends to make the free ends and therefore the nozzles 40 extend farther from the fittings 38 and to thereby travel closer to the surface of roof 12 and to discharge water at an even lower angle. Thus, the apparatus of the present invention not only avoids loss of water due to the wind because of its low angle of discharge, but actually provides an even lower angle of discharge under high wind conditions to further minimize losses.

Figure 5:
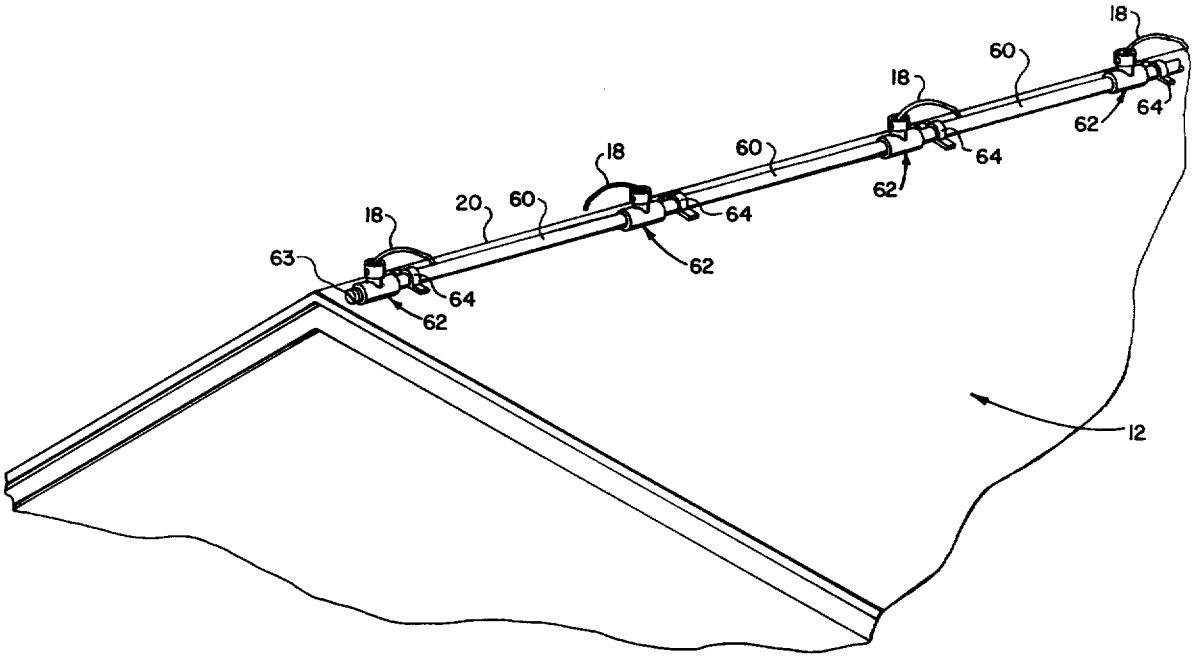
FIG. 5 is an illustration of a portion of a roof sprinkling system in accordance with another embodiment of the present invention.
Figure 6:
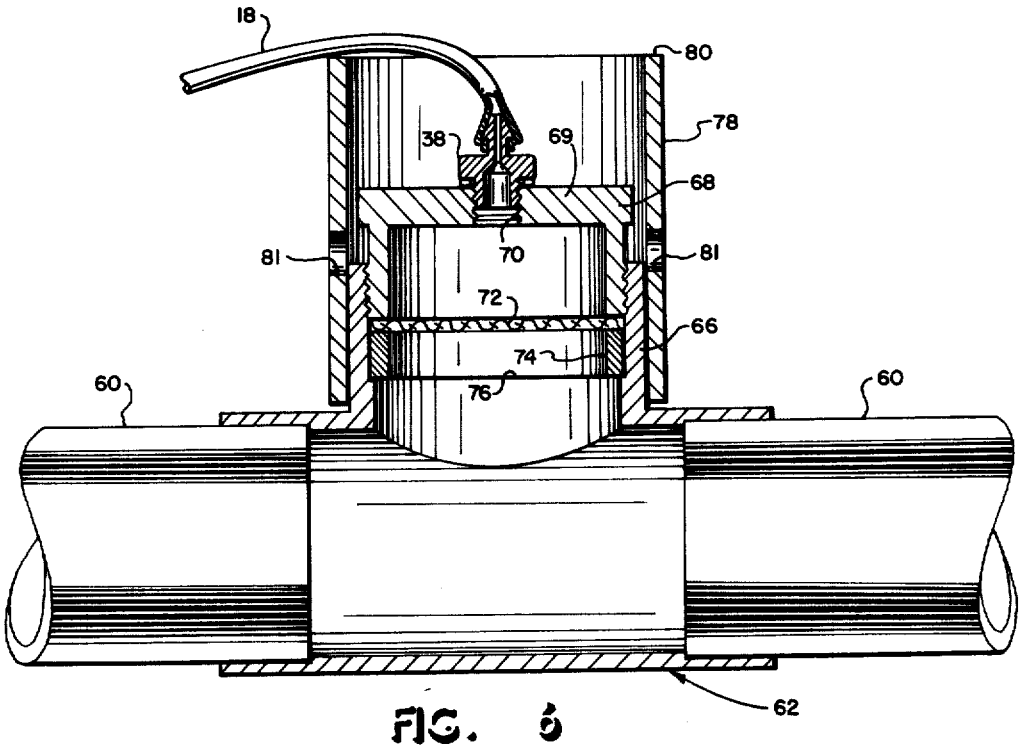
FIG. 6 is a vertical longitudinal section view of a portion of the system shown in FIG. 5.

Another preferred embodiment according to the present invention is illustrated in FIGS. 5 and 6 of the drawings. Referring to FIGS. 5 and 6 a water sprinkler apparatus according to the present invention is illustrated, in part, disposed on the roof 12 in a manner similar to the apparatus illustrated in FIG. 1. The water sprinkler apparatus according to the embodiment shown in FIG. 5 comprises a main water supply conduit characterized by sections of pipe 60 interconnected with spaced apart tee fittings 62, as shown, to form an elongated conduit means at or near the ridge 20. The conduit formed by the pipe sections 60 and tee fittings 62 may be connected to the permanent conduit 22 in a manner similar to the arrangement shown in FIG. 1. If a tee fitting is disposed at the end of the main supply conduit, it may be provided with a suitable plug 63 in place of a continuing section of conduit 60. The conduit sections 60 and the tee fittings 62 are also preferably formed of PVC plastic pipe. The conduit assembly formed by the conduit sections 60 and tee fittings 62 may be suitably retained on the roof 12 by spaced apart brackets 64, for example.

As shown in FIG. 5, the spaced apart tee fittings 62 are arranged to have their respective base leg portions 66 projecting substantially vertically upward and forming branch conduits to which are suitably connected the flexible tubes 18, as shown in FIGS. 5 and 6. Referring particularly to FIG. 6 one of the tee fittings 62 is shown in longitudinal section. The tee fittings 62 are each provided with a plug 68 insertable in the upstanding base leg portion 66. The plug 68 includes a transverse end wall 69 provided with a tapped hole 70 for receiving the fitting 38 threadedly engaged therein. The tee fitting 62 is also provided with filter means comprising a fine mesh screen 72 disposed between the bottom of the plug 68 and a supporting collar 74 insertable within the bore of the base leg 66 and suitably retained therein by a locating ridge or shoulder 76 formed in the tee fitting. The screen 72 provides for filtering out particulate matter entrained in the water to prevent clogging the passageway 52 within the fitting 38, which acts as a pressure reducing orifice, and also to prevent clogging of the directional nozzle 40. The tee fitting 62 and the plug 68 may be formed with cooperating threads, as shown, so that the plug can be removed periodically for cleaning the filter screen 72 as needed.

An important aspect of the embodiment of the present invention shown in FIGS. 5 and 6 pertains to the provision of an upstanding tubular sleeve 78 disposed around the base leg 66 of the tee fitting and suitably secured thereto by an adhesive or interference fit. The tubular sleeve 78 projects upwardly in surrounding relationship to the fitting 38 and the end of the tube 18 connected to the fitting, and is delimited by an upper edge 80. It has been determined that the provision of the tubular sleeves 78 improves the circular swinging or flailing action of the tubes 18 to provide a more uniform motion of the tubes and also provide some support for the tubes near the point of connection to the respective fittings 38. The provision of the tubular sleeves 78 also reduces the tendency for the nozzle 40 to be snagged by the edges of the roof shingles, for example, by supporting tube 18 so that the nozzle 40 does not lay against the roof surface when at rest, or in motion, as a result of water or wind forces. The sleeves 78 are provided with diametrally opposed openings 81 providing drains for any water which might collect within the sleeve and around the plug 68. In a preferred embodiment of the water sprinkler apparatus illustrated in FIGS. 5 and 6 the conduit sections 60 and tee fittings 62 are conventional PVC plastic pipe fittings of nominal diameter of one and three quarters inches. The plug 68 and the sleeve 78 may also be formed of PVC or other suitable plastic materials. The filter 72 is preferably formed of a copper mesh screen.

Various modifications within the scope of the present invention will be apparent to those skilled in the art. For example, the fittings 38 may be formed as separate plastic parts glued into holes drilled into the conduit 60 or the plugs 68, or the fittings could conceivably be molded in place in the respective members. In similar fashion, the nozzles 40 may be formed of materials other than brass, although it is generally believed desirable to employ a material having greater weight per unit length than the tubes 18 to aid in lowering the free ends of the tubes. It is also apparent that the dimensions of the various parts of the apparatus disclosed herein may be modified to increase or decrease the total water flow rate and to compensate for variations in available water pressure. The systems taught herein have been found to provide for effective water distribution at pressures as low as ten pounds per square inch due to the rapid random flailing motion induced by the offset outlet arrangement of the nozzles 40.

What I claim is:

1. Water sprinkler apparatus for distributing water over the surface of a roof comprising:

elongated water supply conduit means adapted to be supported on a roof, a plurality of flexible tubes each having a first end nonrotatably attached to an upper surface of said conduit means at spaced apart intervals along said conduit means and in fluid communication with said conduit means, said tubes being of a flexible material and of a length such that when water is not being forcibly discharged through said tubes said tubes hang with a second end pointing generally downward, and the pressure of water discharged from said tubes is sufficient to raise the second end of said tubes to a point wherein water is discharged from said tubes in a generally horizontal direction over said roof; and a directional nozzle attached to said second end of each of said tubes for receiving fluid from said tube, said nozzle having an outlet angularly displaced from the longitudinal axis of said second end of said tube in such a way as to provide random movement of said second end without forced rotation of said tube about its own longitudinal axis when water is being discharged from said tube through said nozzle.

2. Water sprinkler apparatus according to claim 1 together with:

a pressure reducing orifice connected to said tube at its point of attachment to said conduit means for reducing the pressure in said tube between said orifice and said nozzle.

3. Water sprinkler apparatus according to claim 1 together with:

a fitting having a first end threadably engaging said conduit means and a second end frictionally engaging said first end of said flexible tube, said fitting having an internal passageway providing fluid communication between said conduit means and said tube.

4. Water sprinkler apparatus according to claim 3 wherein:

said internal passageway includes a pressure reducing orifice for reducing the water pressure in said tube between said orifice and said nozzle.

5. Water sprinkler apparatus according to claim 1 wherein:

said flexible tube has a length at least forty times its outer diameter.

6. Water sprinkler apparatus according to claim 5 wherein:

said length is at least six inches and said outer diameter is about one-eighth inch.

7. Water sprinkler apparatus according to claim 1 wherein:

said directional nozzle comprises a rigid tube bent between first and second ends, said rigid tube first end positioned within and frictionally engaging said flexible tube second end.

8. Water sprinkler apparatus according to claim 7, wherein:

said rigid tube second end is bent about 30° from the longitudinal axis of said rigid tube first end.

9. Water sprinkler apparatus according to claim 7 wherein:

said rigid tube has substantially more weight per unit of length than said flexible tube, whereby said flexible tube second end is biased downwardly by the weight of said rigid tube.

10. Water sprinkler apparatus according to claim 7 wherein:

said rigid tube is about one inch long and is bent at about its midpoint.

11. Water sprinkler apparatus according to claim 1 together with:

means forming an upstanding tubular sleeve having an upper edge, said sleeve being disposed around each of said tubes adjacent said first end and adapted to engage a portion of said tube at said first end for guiding said tube during movement thereof to minimize engagement of said nozzle with the surface of said roof.

12. Water sprinkler apparatus according to claim 3 wherein:

said conduit means comprises tubular conduit sections interconnected with spaced apart tee fittings, the base leg of at least one of said tee fittings forming an upstanding conduit branch;

a plug fitted in one end of said conduit branch, said fitting being threadedly engaged with said plug so that said internal passageway is in fluid communication with said conduit means.

13. Water sprinkler apparatus according to claim 12 together with:

water filter means disposed between said internal passageway and said conduit means.

14. Water sprinkler apparatus according to claim 13 wherein:

said filter means comprises a copper mesh screen disposed between said plug and said conduit means.

15. Water sprinkler apparatus according to claim 13 together with:

a tubular sleeve disposed around said conduit branch and projecting generally upwardly in surrounding relationship to said first end of said tube.

16. Water sprinkler apparatus for distributing water over the surface of a roof comprising:

elongated water supply conduit means adapted to be supported on a roof;

a plurality of flexible tubes each having a first end attached to an upper surface of said conduit means at spaced apart intervals along said conduit means and in fluid communication with said conduit means, a pressure reducing orifice interposed in each of said tubes at its point of attachment to said conduit means for reducing the water pressure in said tubes between said orifice and a nozzle attached to a second end of said tubes, said tubes being of a flexible material and of a length such that the pressure of water discharged from said tubes is sufficient to cause the second end of said tubes to discharge water from said tubes in a generally horizontal direction over said roof; and said nozzles having an outlet angularly displaced from the longitudinal axis of said second end of said tube in such a way as to provide random movement of said second end without forced rotation of said tube about its own longitudinal axis when water is being discharged from said tube through said nozzle.

* * * * *